US007226008B2

(12) United States Patent
Nishio

(10) Patent No.: US 7,226,008 B2
(45) Date of Patent: Jun. 5, 2007

(54) BRIQUETTE OF FERROUS METAL WORKING SCRAP, METHOD OF MAKING THE SAME, MASHING CRUSHER OF GRINDING CHIPS AND BRIQUETTE MAKING APPARATUS USING THE SAME

(75) Inventor: Akira Nishio, Hamamatsu (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 113 days.

(21) Appl. No.: 10/515,784

(22) PCT Filed: May 27, 2003

(86) PCT No.: PCT/JP03/06590

§ 371 (c)(1),
(2), (4) Date: Dec. 14, 2004

(87) PCT Pub. No.: WO03/100104

PCT Pub. Date: Dec. 4, 2003

(65) Prior Publication Data

US 2005/0150396 A1 Jul. 14, 2005

(30) Foreign Application Priority Data

May 28, 2002 (JP) ..... 2002-153790
Nov. 20, 2002 (JP) ..... 2002-339792
Nov. 22, 2002 (JP) ..... 2002-339834
May 22, 2003 (JP) ..... 2003-144226

(51) Int. Cl.
*B02C 9/04* (2006.01)
*B02B 5/02* (2006.01)
*B02B 3/02* (2006.01)

(52) U.S. Cl. ..... 241/69; 241/101.2; 241/152.2; 241/260.1; 100/906

(58) Field of Classification Search ..... 241/69, 241/283, 261, 101.2, 152.2, 260.1; 100/906, 100/903, 9; 425/202, 449
See application file for complete search history.

(56) References Cited

U.S. PATENT DOCUMENTS 3,589,276 A * 6/1971 Swallert ..... 100/90

(Continued)

FOREIGN PATENT DOCUMENTS

JP 56-023237 3/1981

(Continued)

*Primary Examiner*—Faye Francis
(74) *Attorney, Agent, or Firm*—Rankin, Hill, Porter & Clark LLP

(57) ABSTRACT

A briquette meeting required strength that is formed in an energy-saving manner from ferrous metal working scrap, such as grinding chips, and a method of making the briquette are provided. In a briquette formed by applying a pressing pressure to a ferrous metal working scrap, the percentage by weight of grinding chips is in the range of 10 wt % to 35 wt %. Viscous water-containing grinding chips crushed to a desired size and metal working scrap, such as gear cutting chips, are mixed in a feed hopper 7, and a pressing pressure is then applied to the raw mix by use of a compression pressing machine 8 to form a briquette B of ferrous metal working scrap. The content of a grinding fluid of the viscous water-containing grinding chips is 20 wt % to 60 wt %.

2 Claims, 5 Drawing Sheets

U.S. PATENT DOCUMENTS

| | | | | |
|---|---|---|---|---|
| 3,657,997 | A * | 4/1972 | Vellella | 100/39 |
| 2001/0050006 | A1 | 12/2001 | Nakamura et al. | |

FOREIGN PATENT DOCUMENTS

| | | |
|---|---|---|
| JP | 11-047626 | 2/1999 |
| JP | 2001-310259 | 11/2001 |
| JP | 2002-146445 | 5/2002 |
| JP | 2002-241854 | 8/2002 |

* cited by examiner

BRIQUETTE OF FERROUS METAL WORKING SCRAP, METHOD OF MAKING THE SAME, MASHING CRUSHER OF GRINDING CHIPS AND BRIQUETTE MAKING APPARATUS USING THE SAME

TECHNICAL FIELD

The present invention relates to a briquette made from metal working scrap discharged as a result of grinding and the like for the purpose of recycling as a material used in blast furnaces, a method of making the briquette, a mashing crusher of grinding chips for the making of the briquette, and a briquette making apparatus using the mashing crusher.

BACKGROUND ART

Conventionally, grinding chips resulting from grinding become spongy bodies that contain a grinding fluid, such as grinding water and grinding oil used during grinding, and after dried in a machining plant, the spongy bodies, are incinerated in an incineration furnace, disposed by landfill for value, or used as a reducing agent for blast furnaces in a steelworks.

For grinding chips containing about 70% of ferrous metals, for example, as described in the Japanese Patent Laid-Open No. 56-23237, a treatment method of briquetting is known so that such grinding chips are reused as a raw material in blast furnaces of a steelworks. In this method, grinding chips, turning chips and metal powders for composition adjustment are blended and heated in a primary heating furnace to remove moisture, oil and the like, whereby a preliminary briquette is made, and after that, briquetting is performed by secondary heating in a high-temperature secondary heating furnace.

Furthermore, as described in the Japanese Patent Laid-Open No. 2002-241854, there is known a method of making a briquette by which grinding chips resulting from grinding are naturally dried to reduce the content of a grinding fluid to not more than 20 wt %, shot waste resulting from shot blasting and gear cutting chips resulting from gear cutting, the oil content of which is reduced to not more than 6 wt %, are added to these grinding chips, the blending ratio of these materials is adjusted to 2 (grinding chips): 1 (shot waste): 7 (gear cutting chips), and a pressing pressure is applied after mixing and string.

However, in the method described in the Japanese Patent Laid Open No. 56-23237, equipment and devices such as a large heating furnace must be provided on a large scale and besides the treatment requires a large quantity of energy, posing the problem that the effect of recycling resources decreases by half.

The briquette making method described in the Japanese Patent Laid-Open No. 2002-241854, which involves mixing shot waste, has the problem that during the extrusion of moisture by applying a pressing force, shot waste becomes a hindrance and that in some ways of mixing, shot waste induces a decrease in shatter strength and variations in required strength after briquetting, thereby causing cracks.

The present invention was made in view of these problems in conventional techniques and has as its object the provision of a briquette meeting required strength that is formed in an energy-saving manner from ferrous metal machining scrap, such as grinding chips, a method of making the briquette, a mashing crusher of grinding chips capable of reducing the energy consumed in briquetting in order to effectively reuse grinding chips, and a briquette making apparatus that uses the mashing crusher.

DISCLOSURE OF THE INVENTION

To solve the above-described problems, a briquette is formed by applying a pressing pressure to ferrous metal working scrap, in which the percentage by weight of grinding chips is 10 wt % to 35 wt %.

According to one aspect of the invention, the briquette of ferrous metal working scrap contains any one of turning chips, gear cutting chips and press scrap as a component other than the grinding chips.

The invention also includes a method of making a briquette of ferrous metal working scrap, which comprises the steps of: mixing viscous water-containing grinding chips crushed to a desired size and metal working scrap, such as gear cutting chips, and applying a pressing pressure to the material mix to form a briquette of ferrous metal working scrap.

According to another aspect of the invention, in the method of making a briquette of ferrous metal working scrap, the content of a grinding fluid of the water-containing grinding chips is not less that 20 wt % but not more that 60 wt %.

The invention further includes a mashing crusher that crushes grinding chips solidified in a dried condition to a desired size, which comprises a plurality of cylindrical biting-in bars, a plurality of partition plates arranged above the biting-in bars, an outer frame member that fixes the plurality of biting-in bars and partition plates at prescribed intervals, meshed metal members provided in a prescribed arrangement at prescribed intervals from the biting-in bars fixed to the outer frame member, and reciprocal driving means that causes the outer frame member to move reciprocally on the meshed metal members, and crushes solidified grinding chips supplied to within the outer frame member to a desired size by causing the outer frame member to move reciprocally on the meshed metal members.

The invention further includes a mashing crusher that crushes grinding chips solidified in a water-containing condition to a desired size, which comprises a plurality of cylindrical biting-in bars, a plurality of partition plates arranged above the biting-in bars, an outer frame member that fixes the plurality of biting-in bars and partition plates at prescribed intervals, meshed metal members provided in a prescribed arrangement at prescribed intervals from the biting-in bars fixed to the outer frame member, and reciprocal driving means that causes the outer frame member to move reciprocally on the meshed metal members, and crushes solidified grinding chips supplied to within the outer frame member to a desired size by causing the outer frame member to move reciprocally on the meshed metal members.

According to another aspect of the invention, by use of a screw-conveyor crusher that comprises a screw conveyor for grinding chip supply that is provided in the vicinity of the crushing arms, the maxing crusher of grinding chips crushes the solidified grinding chips to an appropriate size and then supplies the crushed solidified grinding chips to within the outer frame member.

The invention further includes a briquette making apparatus that comprises the mashing crusher of grinding chips and the screw conveyor that supplies turning chips and/or gear cutting chips, and performs a synchronized operation of the screw conveyor for grinding chip supply and the screw conveyor that supplies the turning chips and/or gear cutting chips, thereby causing the grinding chips and the turning chips and/or gear cutting chips to fall onto the transfer conveyor of the compression pressing machine at a desired blending ratio.

BEST MODE FOR CARRYING OUT THE INVENTION

Figure 1:
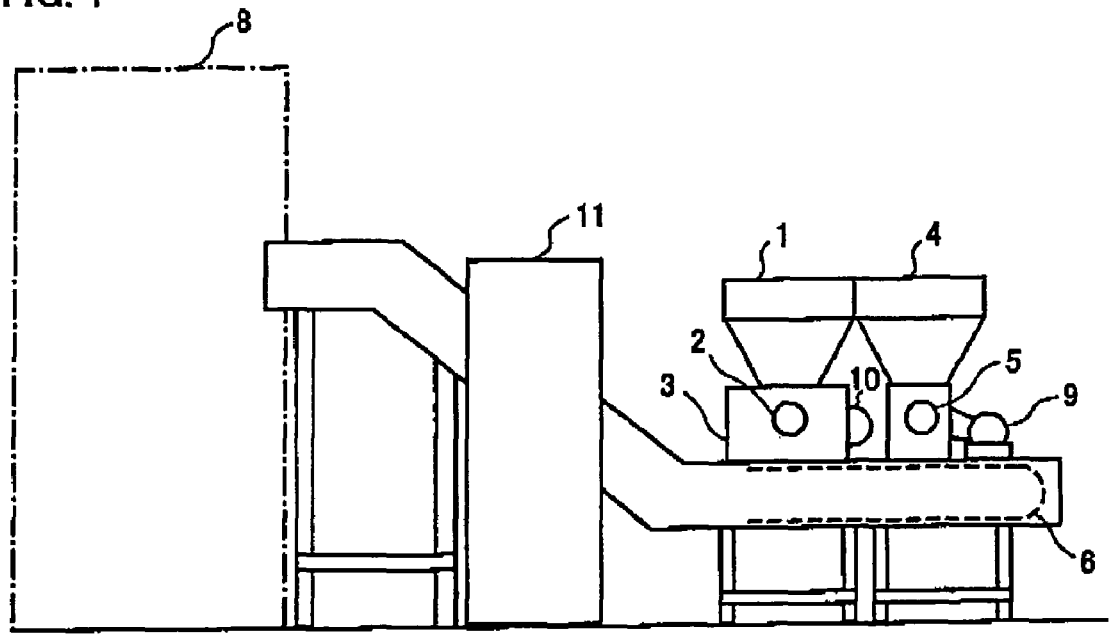
FIG. 1 is a schematic side view of a briquette making apparatus.
Figure 2:
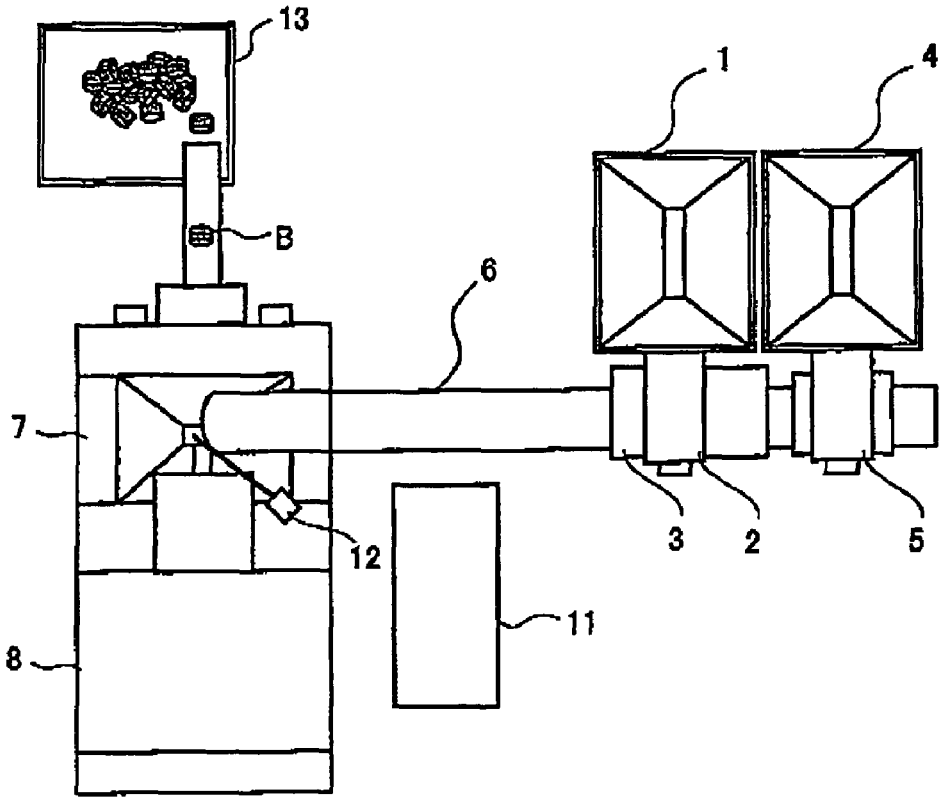
FIG. 2 is a schematic top view of a briquette making apparatus.
Figure 3:
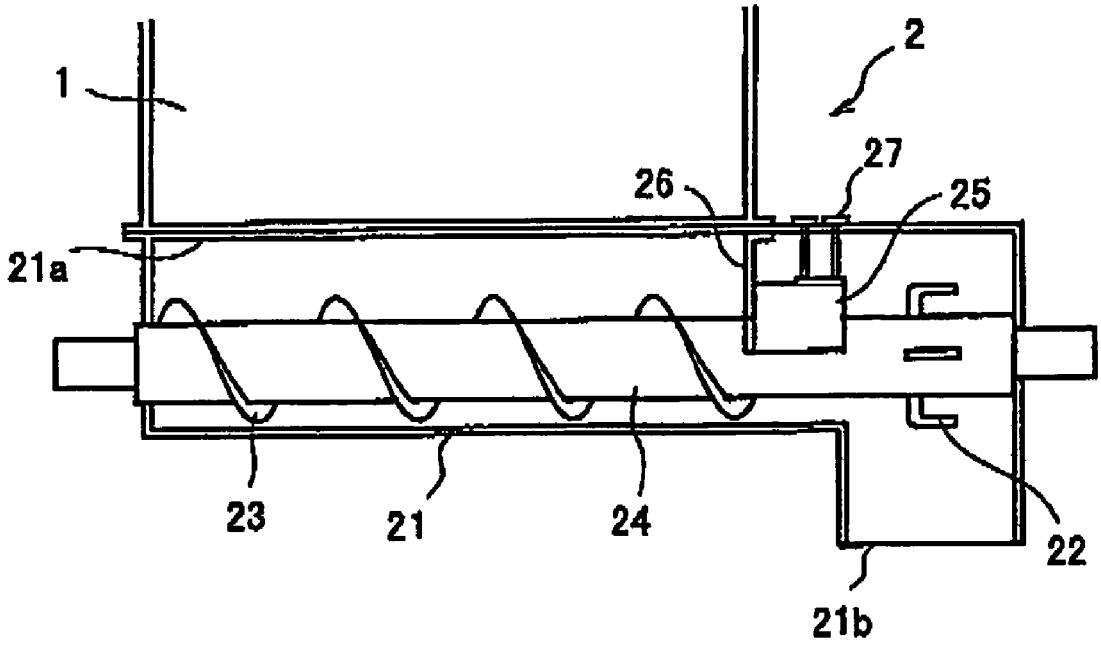
FIG. 3 is a side view of a screw conveyor crusher.
Figure 4:
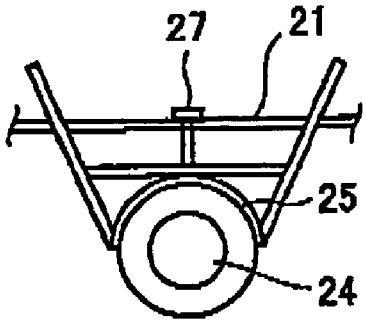
FIG. 4 is a front view of a holding plate.
Figure 5:
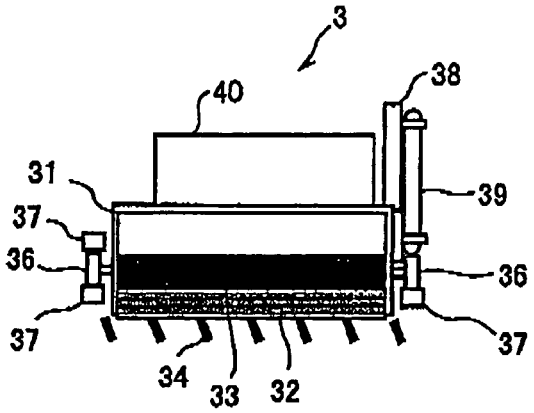
FIG. 5 is a schematic front view of a mashing crusher.
Figure 6:
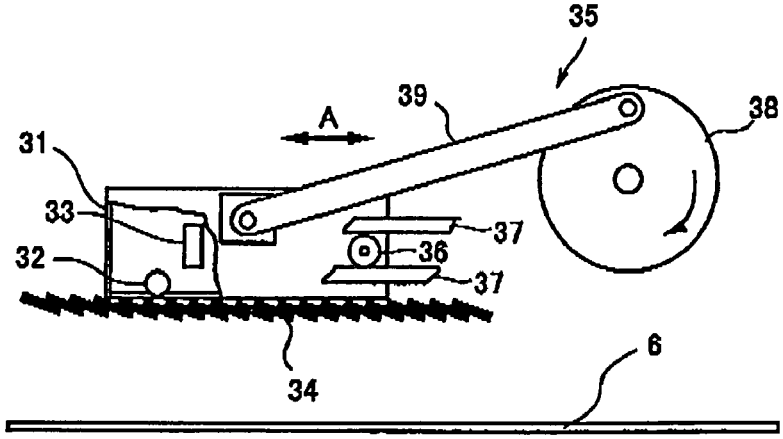
FIG. 6 is a schematic side view of a mashing crusher.
Figure 7:
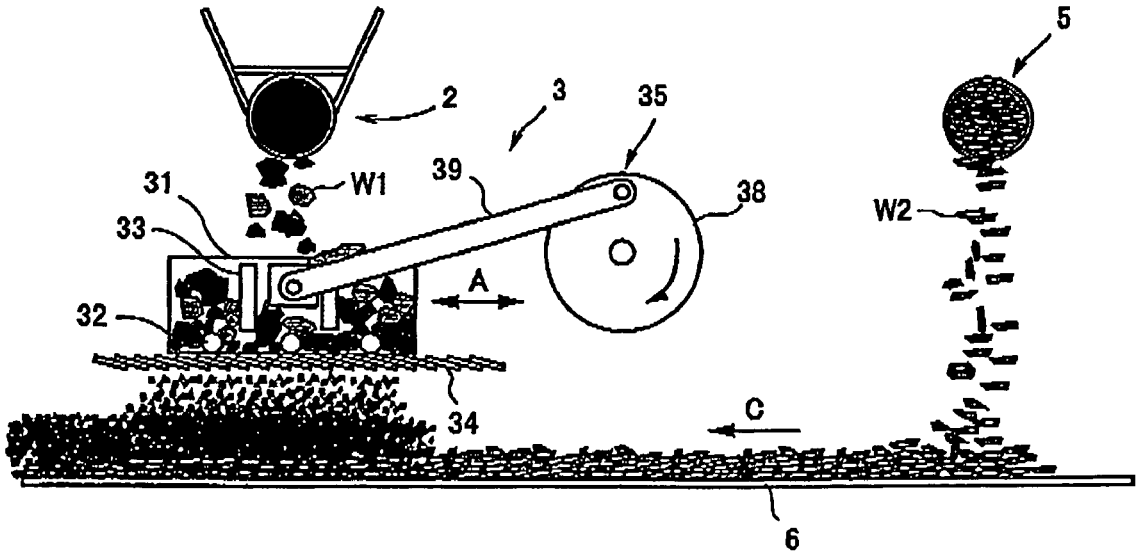
FIG. 7 is a drawing to explain the operation of a briquette making apparatus.
Figure 8:
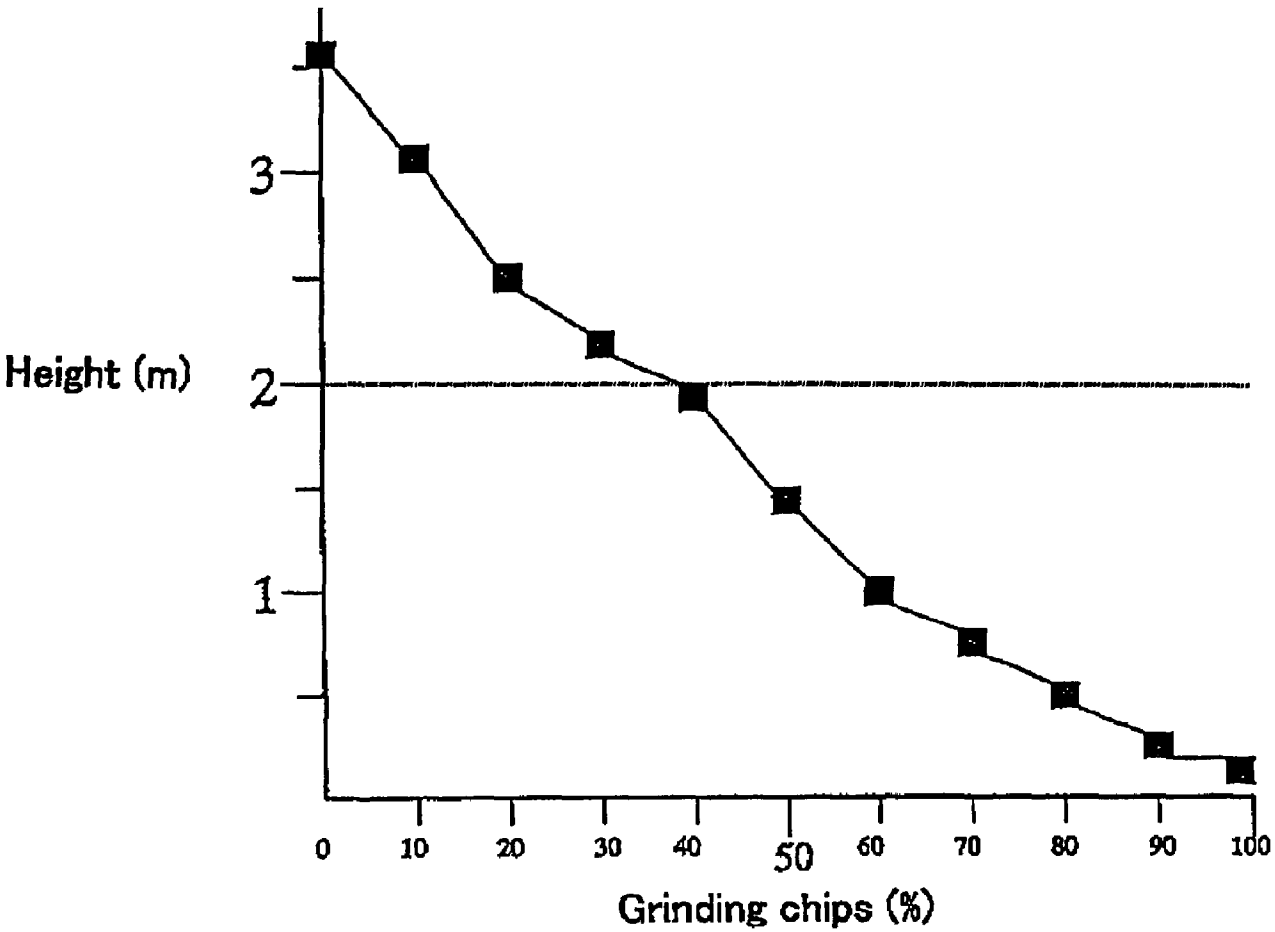
FIG. 8 is a drawing that shows the relationship between the blending ratio of grinding chips and gear cutting chips and shatter strength.
Figure 9:
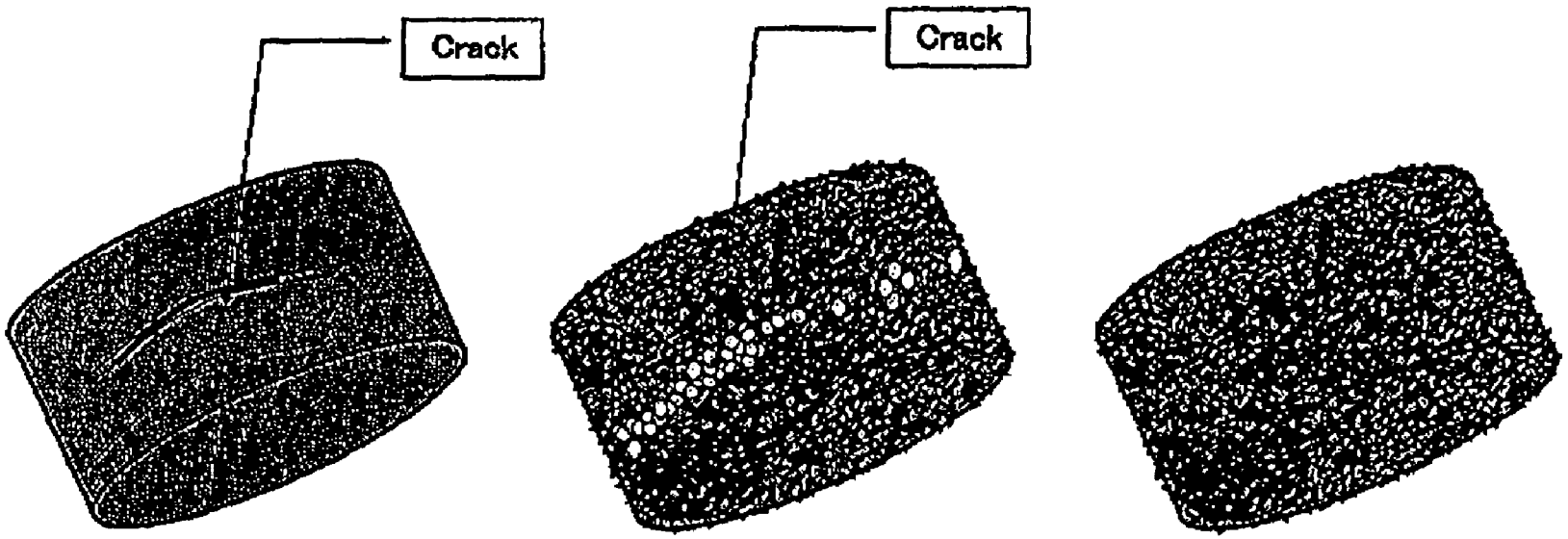
FIG. 9 is a perspective view of a briquette.

Embodiments of the invention will be described below on the basis of the accompanying drawings, in which FIG. 1 is a side view of a briquette making apparatus, FIG. 2 is a top view of the same, FIG. 3 is a side view of a screw conveyor crusher, FIG. 4 is a front view of a holding plate, FIG. 5 is a schematic front view of a mashing crusher, FIG. 6 is a schematic side view of the same, FIG. 7 is a drawing to explain the operation of a briquette making apparatus, FIG. 8 is a drawing that shows the relationship between the blending ratio of grinding chips and gear cutting chips and shatter strength, and FIG. 9 is a perspective view of a briquette.

A briquette of ferrous metal working scrap according to the invention is formed in a blending ratio of grinding chips between 10 and 35 wt % to gear cutting chips between 90 and 65 wt %. In addition to the gear cutting chips, any one of turning chips and press scrap may be used as a component to be blended with the grinding chips.

Gear cutting chips refer to metal scrap resulting from the working by use of a hobbing machine and a gear shaper and are ferrous granular chips of 1 to 4 mm or so. Gear cutting chips are mixed after the oil content is removed to not more than 6 wt % by use of a centrifugal separator. In recent years, however, gear cutting has been performed in a dry state and performing gear cutting without using a cutting oil has become mainstream.

Turning chips are metal scrap resulting from lathing and working by use of a drilling machine, a milling machine, etc. and refer to helical or gently linear continuous chips. Incidentally, if turning chips are in a somewhat long state, this may sometimes cause a hindrance during transfer and, therefore, it is desirable to cut or crush such long turning chips to a desired length before use.

Next as shown in FIGS. 1 and 2, a briquette making apparatus according to the invention comprises a grinding chip hopper 1, a screw-conveyor crusher 2 that crushes solidified grinding chips supplied from the grinding chip hopper 1 to a certain size, a mashing crusher 3 that further crushes the grinding chips carried in from the screw conveyor crusher 2 to a desired size, a gear cutting chip hopper 4, a screw conveyor 5 that transfers gear cutting chips supplied from the gear cutting chip hopper 4, a transfer conveyor 6 that transfers the grinding chips crushed by the mashing crusher 3 and the gear cutting chips transferred by the screw conveyor 5 while blending them, a supply hopper 7 that stores the raw mix of grinding chips and gear cutting chips transferred by the transfer conveyor 6, and a compression pressing machine 8 that makes a briquette B by pressing the raw mix supplied from the supply hopper 7.

Incidentally, the reference numeral 9 denotes a motor that drives the screw-conveyor crusher 2, the reference numeral 10 a motor that drives the screw conveyor 5, the reference numeral 11 a control panel, and the reference numeral 12 an infrared sensor that detects the storage volume to prevent an overflow from the supply hopper 7.

As shown in FIG. 3, the screw-conveyor crusher 2 is disposed within a guide member 21 in communication with the grinding chip hopper 1 and comprises a screw conveyor 24 that is provided, at the leading end thereof, with key-like crushing arms 22 and, on the peripheral surface thereof, with a conveyor fin 23, and a holding plate 25 that is installed fixedly in the guide member 21 in the vicinity of the crushing arms 22.

The guide member 21 is formed so as to cover the screw conveyor 24, with an inlet 21*a* that receives the solidified grinding chips supplied from the grinding chip hopper 1 formed on a top surface thereof and an outlet 21*b* that delivers the solidified grinding chips to the mashing crusher 3 after being crushed to a certain size formed on a bottom surface thereof in the vicinity of the crushing arms 22.

As shown in FIG. 4, the holding plate 25 is formed in circular are form along the periphery of the screw conveyor 24 provided, on the peripheral surface thereof, with the conveyor fin 23, so as to form a prescribed gasp from the conveyor fin 23. Incidentally, the reference numeral 26 denotes a guide plate that guides grinding chips to between the screw conveyor 24 end the holding plate 25, and the reference numeral 27 denotes a bolt that fixes the holding plate 25 to the guide member 21.

As shown in FIGS. 5 and 6, the mashing crusher 3 comprises an outer frame member 31 having open top and bottom surfaces, a plurality of cylindrical biting-in bars 32 fixed at prescribed intervals to lower right and left inner wall surfaces of the outer frame member 31, a plurality of partition plates 33 that are arranged above these biting-in bars 32 and fixed to right and left inner wall surfaces of the outer frame member 31, meshed metal members 34 provided in a prescribed arrangement at prescribed intervals from the biting-in bars 32, and reciprocal driving means 35 that causes the outer frame member 31 to move reciprocally in the directions of arrow A on the meshed metal members 34. Incidentally, it is preferred that the partition plates 33 be arranged in the middle of the pitch of the biting-in bars 32, as shown in FIG. 7.

The reciprocal driving means 35 comprises four cam followers 36 provided on front and rear, right and left outer wall surfaces of the outer frame member 31, four guide rails 37 laid on a tame body (not shown) so as to sandwich these cam followers 36, a connecting rod 39 an end of which is connected to an outer wall surface of the outer frame member 31 and the other end of which is connected to an edge of a crank part 38, and a motor 40 that rotates the crank part 38.

The operation of the briquette making apparatus constructed as described above and a method of making a briquette will be described below.

First, viscous water-containing grinding chips discharged in grinding are accumulated and collected by a dedicated car or the lie and put into the grinding chip hopper 1. The collected grinding chips are spongy bodies that contain a grinding fluid, such as grinding water and grinding oil, in an amount of not less than 20 wt % but not more than 60 wt %.

On the other hand, gear cutting chips resulting from gear cutting are collected and put into the gear cutting chip hopper 4. When a grinding oil is use, the oil content is lowered to not more than 6 wt % by use of a centrifugal separator. On this occasion, the size of the gear cutting chips is 1 to 4 mm or so.

When the viscous grinding chips in a water-containing condition that are supplied from the grinding chip hopper 1 are delivered to the screw-conveyor hopper 2, the screw conveyor 24 is rotationally driven by the motor 9 to transfer the grinding chips toward the outlet 21*b*. Then, the grinding chips solidified in a water-containing condition enter the gap between the screw conveyor 24 and the holding plate 25 by the action of the guide plate 26 and the holding plate 25 and are crushed to a certain size by the crushing arms 22 that rotate together with the screw conveyor 24.

As shown in FIG. 7, the grinding chips W1 crushed to a certain size are put within the outer frame member 31 of the mashing crusher 3. Then, by the reciprocal movement of the outer frame member 31 provided with the plurality of biting-in bars 32 and partition plates 33 on the meshed metal members 34, each of the biting-in bars 32 pushes the grinding chips W1 against the meshed metal members 34. And, the grinding chips W1 pass through the meshed metal members 34, are crushed to sizes smaller than the size of the network at least and fall onto the transfer conveyor 6.

It became apparent that the size of the grinding chips W1 during mixing with gear cutting chips W2 on the supply conveyor 7 has an effect on the strength of a briquette B. In order to increase the strength of the briquette B, it is desirable to chips the grinding chips W1 to smaller sizes and to uniformly disperse the grinding chips W1 within the briquette B. Furthermore, even when the percentage by weight of the grinding chips W1 is lowered, because of the viscosity of the grinding chips W1 that have passed trough the metal members 34, in some sizes the grinding chips W1 may adhere to each other and be contained as large agglomerates within the briquette B, with the result that these parts initiate cracks.

Therefore, it is preferred that the size of the grinding chips W1 that have passed through the meshed metal members 34 be not more than 20 mm in diameter so that the grinding chips 1 are uniformly dispersed within the briquette B to increase strength. The size of the grinding chips W1 that are put into the supply hopper 7 can be arbitrarily set by appropriately selecting the size of the meshes of the metal members 34.

On the other hand, the gear cutting chips W2 supplied from the gear cutting chip hopper 4 are transferred by the screw conveyor 5 and fall onto the transfer conveyor 6.

Then, the grinding chips W1 and the gear cutting chips W2 are blended on the transfer conveyor 6, transferred in the direction of the arrow C and put into the supply hopper 7 that stores the raw mix of the grinding chips W1 and the gear cutting chips W2.

The blending ratio of the grinding chips W1 and the gear cutting chips W2 can be arbitrarily set by controlling the number of revolutions of the motor 9 that drives the screw conveyor 24 and the number of revolutions of the motor 10 that drives the screw conveyor 5 thereby to adjust the amount of the grinding chips W1 transferred to the mashing crusher 3 and the amount of the gear cutting chips W2 transferred to the transfer conveyor 6.

That is, it is necessary only that synchronized operation of the motor 9 and the motor 10 be performed in consideration of the amount of the grid chips W1 transferred per revolution for the screw conveyor 24 and the amount of the gear cutting chips W2 transferred per revolution for the screw conveyor 5.

Subsequently, the grinding chips W1 and the gear cutting chips W2 are mixed in the supply hopper 7 and supplied to the compression pressing machine 8. When the raw mix is compressed by the compression pressing machine 8, the grinding fluid of the water-containing grinding chips is discharged in the direction in which the pressure is applied and a direction opposite to this direction On that occasion, the grinding fluid runs through the gear cutting chips that become aggregates and discharge onto the wall surfaces of press dies (not shown).

And, after a constant pressing pressure is held for a prescribed time, a piston (not shown) opens a pressure receiving door (not shown) and pushes the briquette B to outside the press dies. Furthermore, when the piston has moved forward to the end of the pressure receiving door, the oil, moisture and the like add to the wall surfaces of the press dies run through a drain groove (not shown) and are discharged downward.

Then, the formed briquette B is delivered and housed on a truck 13.

Even when the briquette B made in the above described method is caused to fall from a height of 2 m, cracks or fissures dot not occur and required strength is satisfied. As shown in FIG. 8, in the case of the briquette B formed by blending grinding chips and gear cutting chips, it is apparent that required shutter strength (specified height: not less than 2 m) can be satisfied by keeping the amount of grinding chips at not more than about 35 wt %.

In the briquette B of ferrous metal working chips according to the invention, forming was performed without mixing shot scrap. This is because it became apparent that in a case where shot scrap is mixed with grinding chips etc., if shot waste is unevenly dispersed and the greater par of the shot waste is present only at one side in some ways of mixing, cracks occur, resulting in a decrease in the shatter so of the briquette and variations in required strength.

As shown in FIG. 9, cracks occur when the briquette is made of 20 wt % of cutting chips, 70 wt % of gear cutting chips and 10 wt % of shot waste. That is, a decrease in shatter strength is induced by mixing 10 % of shot waste even when the amount of cutting chips is not more than 35 wt %.

On the other hand, cracks do not occur in a case where the briquette is made of 30 wt % of grinding chips and 70 wt % of gear cutting chips. This is apparent also from the relationship between the blending ratio of grinding chips and gear cutting chips and shatter strength shown in FIG. 8. When the amount of grinding chips is 100 wt %, cracks occur as is apparent from the shatter strength shown in FIG. 8.

Incidentally, in this embodiment, descriptions were given of a briquette in which gear cutting chips are blended to grinding chips, a method of making the briquette, and a briquette making apparatus. However, in place of gear cutting chips, other metal working scrap, such as tuning chips and press scrap, can be used. In this case, it is necessary only that a briquette making apparatus be constructed by replacing the gear cutting chip hopper 4 with a turning chip hopper and replacing the screw conveyor 5 that transfers gear cutting chips with a screw conveyor that transfers turning chips.

Also, it is possible to blend both turning chips and gear cutting chips with grinding chips at a desired blending ratio. In this case it is possible to construct a briquette making at by providing a gear cutting chip hopper and a new screw conveyor that transfers gear cutting chips or it is possible to construct a briquette making apparatus in such a manner that turning chips and gear cutting chips are put into the gear cutting chip hopper 4 in a mixed manner and the raw mix of turning chips and gear cutting chips is supplied from the screw conveyor 5 to the transfer conveyor 6.

Incidentally, in general, the solidified grinding chips to be crushed by the mashing crusher according to the invention are solidified, with moisture contained in the interior even when the surface is dry.

INDUSTRIAL APPLICABILITY

As described above, a briquette is formed from ferrous metal working scrap, such as grinding chips, in an energy-saving manner and the briquette can meet required strength.

Further, a briquette can be formed from ferrous metal working scrap, such as viscous water-containing grinding chips, without natural drying in an energy-saving manner and costs can be reduced.

Also, grinding chips that are solidified in a dried condition can be crushed to a desired size by use of a simple mechanism.

Also, grinding chips that are solidified in a water-containing condition can be crushed to a desired size by use of a simple mechanism.

Further, solidified grinding strips can be smoothly crushed to a desired size by causing the solidified grinding chips to pass through a screw-conveyor crusher and a mashing crusher.

The energy consumed in briquetting can be saved in order to effectively reuse grinding chips.

The invention claimed is:

1. A briquette making apparatus comprising:

a mashing crusher that crushes grinding chips solidified in a dried condition to a desired size, wherein the mashing crusher comprises:

a plurality of cylindrical biting-in bars, a plurality of partition plates arranged above the biting-in bars, an outer frame member that fixes said plurality of biting-in bars and partition plates at prescribed intervals, meshed metal members provided in a prescribed arrangement at prescribed intervals from said biting-in bars fixed to the outer frame member, and reciprocal driving means that causes said outer frame member to move reciprocally on the meshed metal members, and crushes solidified grinding chips supplied to within said outer frame member to a desired size by causing said outer frame member to move reciprocally on said meshed metal members; and, a screw conveyor-crusher that supplies grinding chips to said mashing crusher, said screw conveyor-crusher comprising a first screw conveyor that is provided at a leading end thereof with crushing arms and a holding plate, said holding plate being provided in the vicinity of said crushing arms, the screw-conveyor crusher crushes solidified grinding chips to an appropriate size and then supplies the crushed solidified grinding chips to within said outer frame member of the mashing crusher;

wherein said briquette making apparatus performs a synchronized operation of said first screw conveyor for grinding chip supply and a second screw conveyor that supplies at least one of turning chips and gear cutting chips, thereby causing the grinding chips and the at least one of the turning chips and the gear cutting chips to fall onto a transfer conveyor of a compression pressing machine at a desired blending ratio, and wherein said desired blending ratio is a ratio between the grinding chips and the at least one of the turning chips and the gear cutting chips.

2. A briquette making apparatus comprising:

a mashing crusher that crushes grinding chips solidified in a water-containing condition to a desired size, wherein the mashing crusher comprises:

a plurality of cylindrical biting-in bars, a plurality of partition plates arranged above the biting-in bars, an outer frame member that fixes said plurality of biting-in bars and partition plates at prescribed intervals, meshed metal members provided in a prescribed arrangement at prescribed intervals from said biting-in bars fixed to the outer frame member, and reciprocal driving means that causes said outer frame member to move reciprocally on the meshed metal members, and crushes solidified grinding chips supplied to within said outer frame member to a desired size by causing said outer frame member to move reciprocally on said meshed metal members; and, a screw conveyor-crusher, which supplies grinding chips to said mashing crusher, said screw conveyor-crusher comprising a first screw conveyor that is provided at a leading end thereof with crushing arms and a holding plate, said holding plate being provided in the vicinity of said crushing arms, screw conveyor-crusher crushes said solidified grinding chips to an appropriate size and then supplies the crushed solidified grinding chips to within said outer frame member of said mashing crusher;

wherein said briquette making apparatus performs a synchronized operation of said first screw conveyor for grinding chip supply and a second screw conveyor that supplies at least one of turning chips and gear cutting chips, thereby causing the grinding chips and the at least one of the turning chips and the gear cutting chips to fall onto a transfer conveyor of a compression pressing machine at a desired blending ratio, and wherein said desired blending ratio is a ratio between the grinding chips and the at least one of the turning chips and the gear cutting chips.

* * * * *

UNITED STATES PATENT AND TRADEMARK OFFICE

CERTIFICATE OF CORRECTION

PATENT NO. : 7,226,008 B2
APPLICATION NO. : 10/515784
DATED : June 5, 2007
INVENTOR(S) : Nishio It is certified that error appears in the above-identified patent and that said Letters Patent is hereby corrected as shown below:

On the Title Page, item [30] Foreign Application Priority Data, delete "Nov. 20, 2002 (JP)...2002-339792" and insert --Nov. 22, 2002 (JP)....2002-339792--.

Column 8, Line 43, (Claim 2, Line 25), after "arms," insert --the--.

Signed and Sealed this

Thirty-first Day of July, 2007

JON W. DUDAS
*Director of the United States Patent and Trademark Office*